United States Patent [19]

Lazcano-Navarro et al.

[11] Patent Number: 4,531,718

[45] Date of Patent: Jul. 30, 1985

[54] IRON ORES TREATMENT APPARATUS

[76] Inventors: Arturo Lazcano-Navarro; Antonio Villasenor-Mejia, both of Ave. Junco de la Vega #208, Colonia Roma 64700, Monterrey, Nuevo Leon, Mexico

[21] Appl. No.: 642,257

[22] Filed: Aug. 20, 1984

[51] Int. Cl.[3] ..... F27B 1/20

[52] U.S. Cl. ..... 266/186; 266/191; 266/195

[58] Field of Search ..... 266/195, 186, 191

[56] References Cited

U.S. PATENT DOCUMENTS

| | | | |
|---|---|---|---|
| 3,052,457 | 9/1962 | Celada | 75/34 |
| 3,467,368 | 9/1969 | Celada et al. | 266/186 |
| 4,221,366 | 9/1980 | Verdugo et al. | 266/186 |
| 4,238,225 | 12/1980 | Coccia | 75/33 |

*Primary Examiner*—Melvyn J. Andrews

*Attorney, Agent, or Firm*—Laurence R. Brown

[57] ABSTRACT

A fixed bed reactor specially adapted to be used in the gas-solid reaction for the production of sponge iron. The flow of gas is ascendant, entering at the bottom through a gas distributor specially designed to assure a uniform gas flow.

1 Claim, 1 Drawing Figure

IRON ORES TREATMENT APPARATUS

BACKGROUND OF THE INVENTION

The apparatus in this invention is characterized by gas entries located in the bottom; usually in the related art, the gas entrance is at the top and the outlet is at the bottom; The disadvantage of having descendant flow is that at the bottom the reactor usually has a very bad gas flow, which requires in this zone an inert material, reducing the operation space in the reactor which causes problems with subsequent separations of this inert material from sponge iron.

Another disadvantage of the known art is that the gas recollection is achieved by a plenum in frustum-conic form which is usually metallic and must be cooled with water by a coil. In the fixed bed reactors with descendant flow, there are in the plenum exit particle entrainment due to the high velocity of the gas reached at this points.

SUMMARY OF THE INVENTION

It is then accordingly an object of the present invention to overcome these disadvantages, since our art with the ascendant flow has a gas irrigation through all the load of ore in uniform form. Cooling is not required in any section of the reactor and particle entrainment is avoided since the gas outlet is at the top having all the transverse area of the reactor as a free area of flow.

DESCRIPTION OF THE INVENTION

Figure 1:
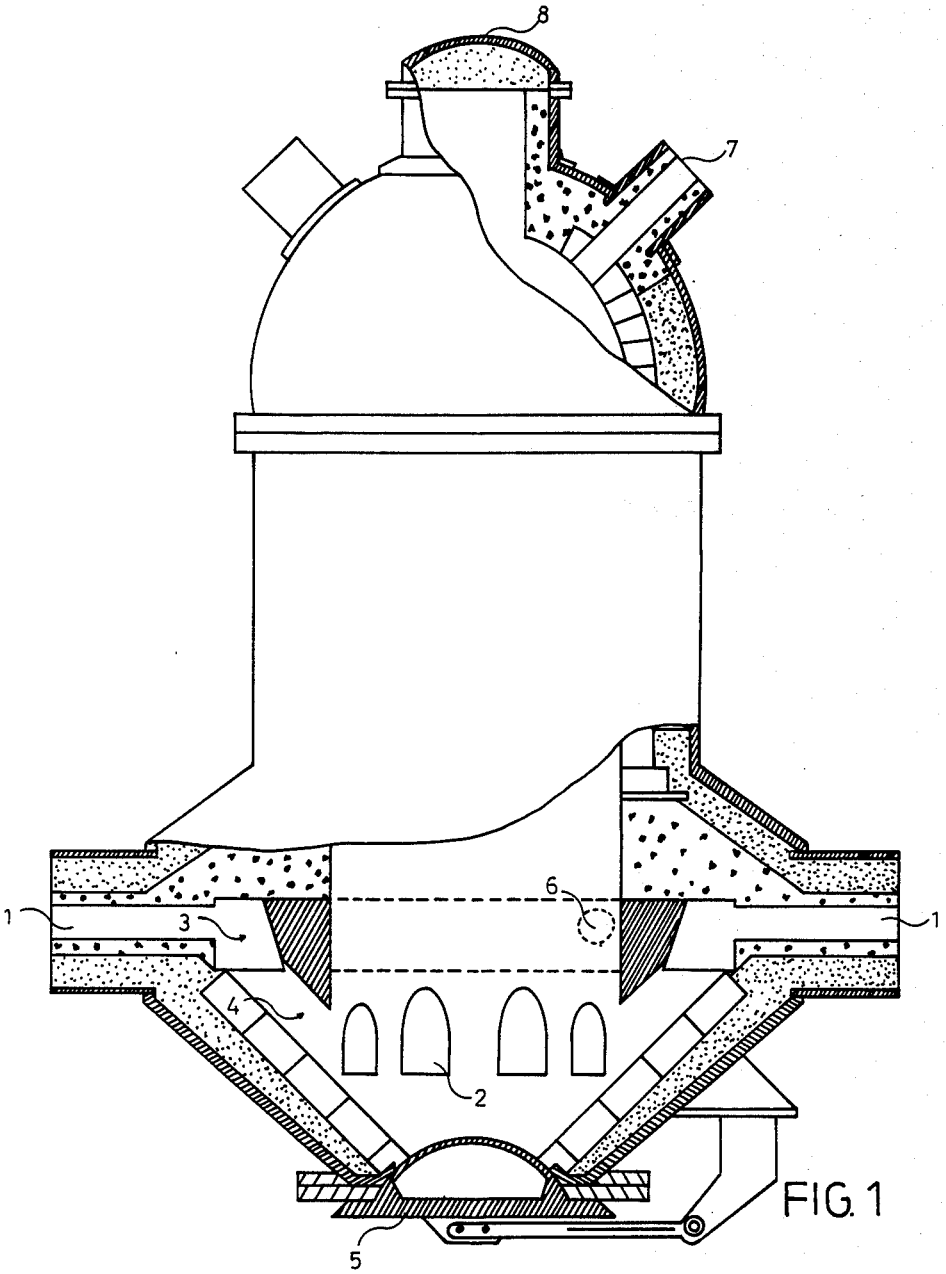
FIG. 1 shows a fragmentary side elevational view, partly in section.

Referring to the drawing, the gas enters through the gas entries (1) which could be one or multiple (in the drawing, two are illustrated). Said entries are insulated since the gas received is hot in the order of 1700 to 1900 F. (800 to 1000 C.) Subsequently the gas is distributed by a ring (3) and through the channels (4), is injected to the reactor. In order to have a better gas distribution, the flow transversal areas (2) of the said distribution channels (4) may increase alike the entries (1) withdraws, in this way the pressure drops are uniform through said channels (4), so the flow in each channel (4) is the same, with this, the uniform gas distribution is assured. The inclination of the channels can be 35° to 45° down. It was found experimentally that in this range the gas reaches until the upper part of the cover (5). The angle of 45° is preferred to avoid stickness of sponge iron to the walls of the furnace to unload it through said cover.

The cooling gas entries (6) are as close as possible to the hot has entries (1) having a cool gas entry (6) for each hot gas entry. This is in order that during the cooling cycle of the sponge iron the cooling gas is distributed in the same way of the hot gas.

The gas outlets (7) are located at the top of the reactor the number of gas outlets (7) may be the same as the gas entries (1) though it was demonstrated experimentally that if a uniform flow is desired the gas outlets (7) must be at least two.

The reactor has two sealing covers (5) and (8), the upper (8), where the reactor is filled, and the cover (5) where the reactor is unloaded, each have automatic mechanisms to open and close.

The reactor has a body with a spherical shape at the top, cross section cylindrical at the middle and inverted frusto-conical bottom.

What we claim is:

1. An iron ore treatment apparatus for the gaseous reduction of iron ore comprising an inverted frusto-conical base, a cylindrical intermediate section of horizontal circular cross-section extending above said base, a dome-like top extending above said intermediate section, a circular gas distributor carried by said base, duct means for introducing hot gas from said distributor through transversely variable cross-sectional channels in gaseous communication with said circular distributor, insulated hot gas supply ducts uniformaly distributed around the base of the apparatus, having hot gas inlet ports in gaseous communication with said circular gas distributor for supplying hot gas thereto, cooling gas entry duct means carried by said circular distributor proximate said duct means for introducing hot gas to said circular distributor, said channels of greater cross-sectional area carried by said circular distributor being further removed from the point of gas introduction into and carried by said circular distributor than said channels of lesser cross-sectional area also being carried by said distributor and being nearer said point of introduction of said hot gas to said distributor, said duct means communicating said circular distributor with said transverse channels being declined at an angle of the order ranging from 35° to 45° from the horisontal, gas outlets positioned in the upper part of said dome-like top, a discharge cover closing the truncated apex of said inverted frusto-conical base, and a charging cover in the top of said dome-like top for charging the apparatus with a fixed bed of iron ore to be treated by passing said hot gas upwardly therethrough.

* * * * *